United States Patent [19]

Bridges

[11] Patent Number: 4,498,535

[45] Date of Patent: Feb. 12, 1985

[54] APPARATUS AND METHOD FOR IN SITU CONTROLLED HEAT PROCESSING OF HYDROCARBONACEOUS FORMATIONS WITH A CONTROLLED PARAMETER LINE

[75] Inventor: Jack E. Bridges, Park Ridge, Ill.

[73] Assignee: IIT Research Institute, Chicago, Ill.

[21] Appl. No.: 445,672

[22] Filed: Nov. 30, 1982

[51] Int. Cl.[3] ..... E21B 43/24; E21B 36/04

[52] U.S. Cl. ..... 166/248; 166/60; 166/245; 166/302; 219/10.81; 219/10.75; 219/10.43

[58] Field of Search ..... 166/60, 65 R, 57, 302, 166/248; 219/10.81, 10.75, 10.55 R, 10.65, 219/10.43

[56] References Cited

U.S. PATENT DOCUMENTS

| | | | |
|---|---|---|---|
| Re. 30,738 | 9/1981 | Bridges et al. | 166/248 |
| 4,135,579 | 1/1979 | Rowland et al. | 166/248 |
| 4,140,179 | 2/1979 | Kasevich et al. | 166/248 |
| 4,140,180 | 2/1979 | Bridges et al. | 166/248 |
| 4,144,935 | 3/1979 | Bridges et al. | 166/248 |
| 4,193,451 | 3/1980 | Dauphine | 166/248 |
| 4,373,581 | 2/1983 | Toellner | 166/60 X |

FOREIGN PATENT DOCUMENTS

| | | | |
|---|---|---|---|
| 672332 | 7/1979 | U.S.S.R. | 166/248 |

OTHER PUBLICATIONS

*Mining Engineering*, "RF Technology said to Offer Advantages in Shale Oil Recovery" Industry Newswatch, Jul. 1978, p. 735.

*Primary Examiner*—George A. Suchfield
*Assistant Examiner*—Michael Starinsky
*Attorney, Agent, or Firm*—Fitch, Even, Tabin & Flannery

[57] ABSTRACT

A system and method provide for preferential in situ heating of earth formations. A plurality of elongated conductive electrodes are emplaced in earth formations in respective spaced rows bounding a particular volume of the earth formations and forming a transmission line, preferably a triplate line, extending in the direction of the electrodes with the particular volume of the earth formations providing a dielectric medium between respective rows of electrodes. Electromagnetic energy is supplied to the transmission line at a frequency at which the spacing between respective rows is less than about twice the skin depth at the frequency of the applied energy. Reactance means are disposed along respective electrodes to provide predetermined effective transmission line characteristics to develop a predetermined heating pattern in the earth formations. The reactance means may be reactances disposed discretely between sections of respective electrodes. The reactance means may also be disposed between respective electrodes and the earth formation, as by a dielectric coating. A heating pattern may be developed to heat hydrocarbon rich deposits preferentially.

22 Claims, 12 Drawing Figures

Fig. 4A.
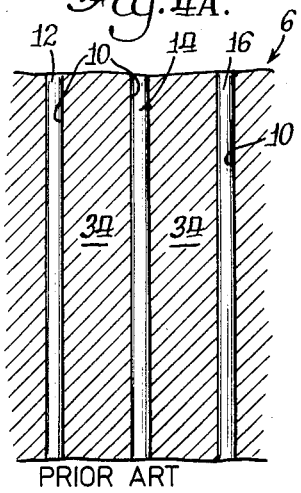
Fig. 4B.
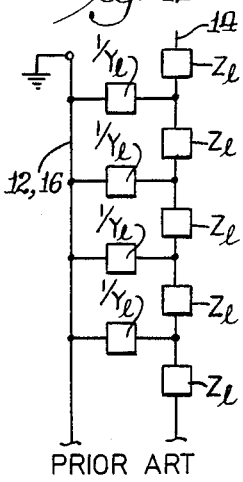
Fig. 5A.
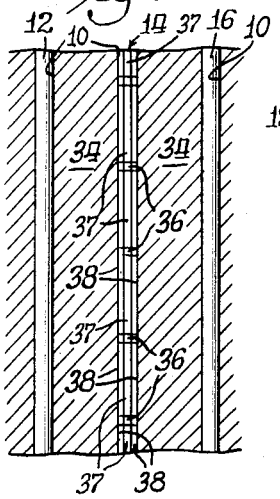
Fig. 5B.
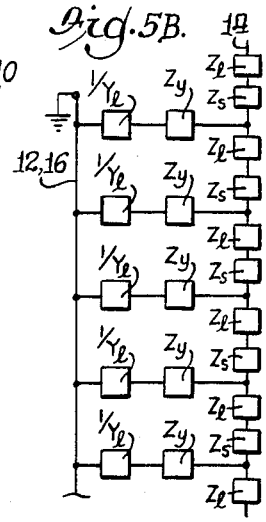
Fig. 6A.
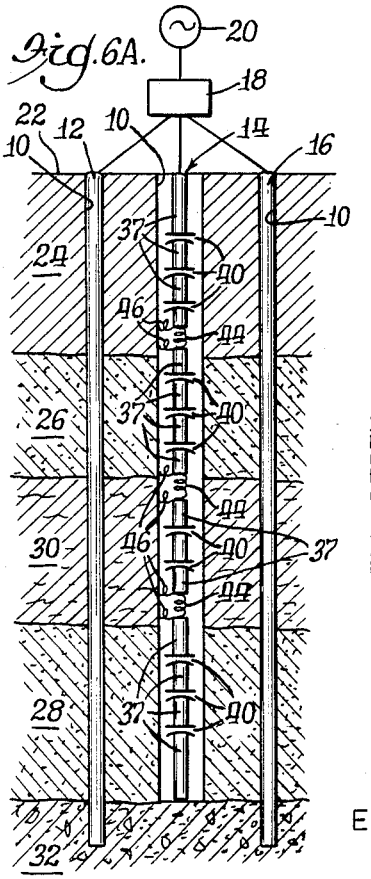
Fig. 6B.
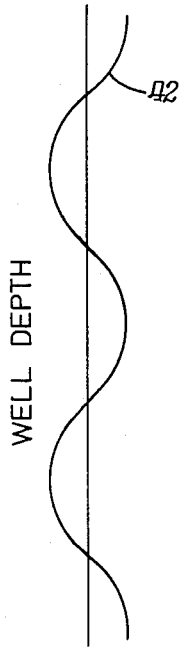
Fig. 6C.
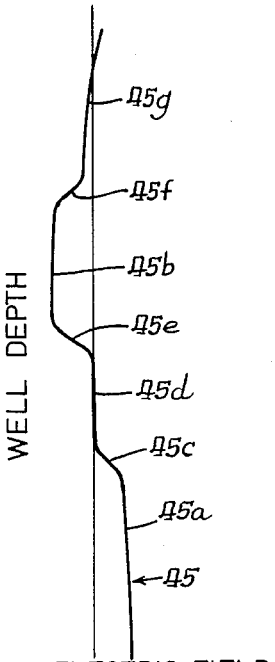
Fig. 8.
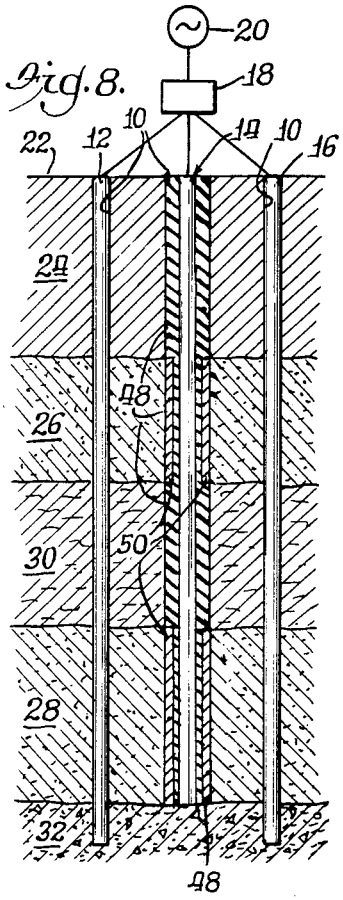
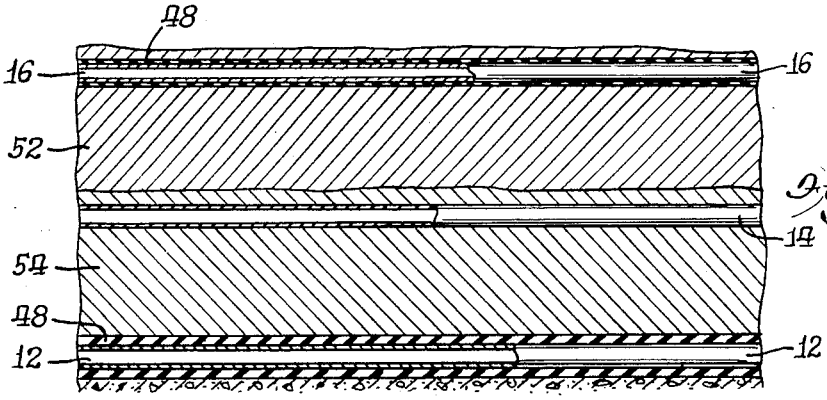
Fig. 7.

APPARATUS AND METHOD FOR IN SITU CONTROLLED HEAT PROCESSING OF HYDROCARBONACEOUS FORMATIONS WITH A CONTROLLED PARAMETER LINE

BACKGROUND OF THE INVENTION

This invention relates to the recovery of marketable products such as oil and gas from hydrocarbon bearing deposits such as oil shale or tar sand by the application of electromagnetic energy to heat the deposits. More specifically, the invention relates to a method and system including use of a high power radio frequency signal generator and an arrangement of elongated electrodes inserted in the earth formations for applying electromagnetic energy to provide controlled heating of the formations. Still more particularly, the invention relates to such method and system wherein reactive elements are disposed along respective elongated electrodes to provide predetermined characteristics for the transmission line formed thereby so as to develop a predetermined heating pattern Materials such as oil shale, tar sands, and coal are amenable to heat processing to produce gases and hydrocarbonaceous liquids Generally, the heat develops the porosity, permeability and/or mobility necessary for recovery. Oil shale is a sedimentary rock which, upon pyrolysis or distillation, yields a condensable liquid, referred to as shale oil, and noncondensable gaseous hydrocarbons. The condensable liquid may be refined into products which resemble petroleum products. Tar sand is an erratic mixture of sand, water and bitumen with the bitumen typically present as a film around water-enveloped sand particles. Using various types of heat processing, the bitumen can be separated. Also, as is well known, coal gas and other useful products can be obtained from coal using heat processing.

In the destructive distillation of oil shale or other solid or semisolid hydrocarbonaceous materials, the solid material is heated to an appropriate temperature and the emitted products are recovered. The desired organic constituent of oil shale, known as kerogen, constitutes a relatively small percentage of the bulk shale material, so very large volumes of shale need to be heated to elevated temperatures in order to yield relatively small amounts of useful end products. The handling of the large amounts of material is, in itself, a problem, as is the disposal of wastes. Also, substantial energy is needed to heat the shale, and the efficiency of the heating process and the need for relatively uniform and rapid heating have been limiting factors on success. In the case of tar sands, the volume of material to be handled, as compared to the amount of recovered product, is again relatively large, since bitumen typically constitutes only about ten percent of the total, by weight. Material handling of tar sands is particularly difficult even under the best of conditions, and the problems of waste disposal are, of course, present there, too.

A number of proposals have been made for in situ methods of processing hydrocarbonaceous deposits and recovering valuable products therefrom. Such methods may involve underground heating or retorting of material in place, with little or no mining or disposal of solid material in the formation. Valuable constituents of the formation, including heated liquids of reduced viscosity, may be drawn to the surface by a pumping system or forced to the surface by injecting another substance into the formation. It is important to the success of such methods that the amount of energy required to effect the extraction be minimized.

It has been known to heat relatively large volumes of hydrocarbonaceous formations in situ using radio frequency energy. This is disclosed in Bridges and Taflove U.S. Pat. No. Re. 30,738. That patent discloses a system and method for in situ heat processing of hydrocarbonaceous earth formations wherein a plurality of conductive means are inserted in the formations and bound a particular volume of the formations. As used therein, the term "bounding a particular volume" was intended to mean that the volume was enclosed on at least two sides thereof In the most practical implementations, the enclosed sides were enclosed in an electrical sense, and the conductors forming a particular side could be an array of spaced conductors. Electrical excitation means were provided for establishing alternating electric fields in the volume. The frequency of the excitation means was selected as a function of the dimensions of the bounded volume so as to establish a substantially nonradiating electric field which was substantially confined in said volume. In this manner, volumetric dielectric heating of the formations occurred to effect approximately uniform heating of the volume.

In the preferred embodiment of the system described in that patent, the frequency of the excitation was in the radio frequency range and had a frequency between about 1 MHz and 40 MHz. In that embodiment, the conductive means comprised conductors disposed in respective opposing spaced rows of boreholes in the formations. One structure employed three spaced rows of conductors which formed a triplate-type of transmission line with the formations as the dielectric between conductors. Particularly as the energy was coupled to the formations (dielectric) from electric fields created between respective conductors, such conductors were, and are, often referred to as electrodes.

The reissue patent disclosed the imposition of standing electromagnetic waves on the electrodes embedded in the formations. Such standing waves create a sinusoidally varying electric field along the length of the transmission line formed by the electrodes, with peaks and nodes separated by a distance equal to one quarter of the wavelength ($\lambda/4$) of the signal applied to the electrodes. This, in turn, creates a heating power which varies in strength along the length of the electrodes and which, consequently, gives rise to heating and temperature variations along the length of the electrodes. As it was desired to provide relatively uniform heating, the system disclosed in that patent provided compensation for such variations in the following ways: (1) by modifying the phase or frequency of the excitation signal, and (2) by decreasing the effective insertion depth of some of the conductors either by pulling some of the conductors part way out of the formation or by employing small explosive charges to sever end segments of the conductors. In addition, as was stated at column 12, lines 43 to 62, capacitive loading could be employed to minimize standing wave amplitude reduction effects, as, for example, by inserting capacitors at regular intervals along the central electrodes for partially canceling the effective series inductance of the center conductors.

In copending application Ser. No. 343,903, filed Jan. 29, 1982 by Bridges and Taflove for Apparatus and Method for In Situ Controlled ,Heat Processing of Hydrocarbonaceous Formations now U.S. Pat. No. 4,449,585, issued May 22, 1984, and commonly assigned, there was disclosed an improvement on the method and system of the reissue patent wherein power was applied at one end of the transmission line and the termination of the distal end of the line was controlled. Terminating one end of the structure with different impedances at different times produced electric field standing waves of different respective phase at that end at the selected frequency. In certain embodiments the difference in phase of the standing waves was made substantially 90° in order that the resultant heating effects for the two respective standing waves be 180° out of phase. At least where the dielectric properties of the formations were relatively uniform, the combined effect of such change of phase was thus to provide substantially uniform heating when the product of the amplitude-squared of the electric field standing wave and the dwell time in the respective phase was substantially the same in the two modes. Such 90° phase shift might be effected by terminating the line alternately with substantially effectively open and short circuits. Pure resistive and pure reactive loads and combination resistive and reactive loads might also be used.

The copending application Ser. No. 343,903 also contemplated a number of desired controlled heating patterns in addition to uniform. These were achieved by utilizing different dwell times and/or different amplitudes of electric field for the different respective standing wave patterns. The use of different frequencies provided further flexibility in the heating patterns that could be established, particularly where the line was terminated differently at the respective frequencies. Also contemplated was the application of electromagnetic energy at different frequencies at the same time while terminating the line differently at the different frequencies to provide a particular programmed heating pattern.

SUMMARY OF THE INVENTION

The present invention is an improvement upon the system and method described in U.S. Pat. No. Re. 30,738, utilizing the same sort of triplate transmission line. The teachings of that reissue patent are hereby incorporated herein by reference.

The present invention provides improved techniques for electromagnetically heating hydrocarbonaceous deposits. The reissue patent disclosed methods wherein the deposit could be uniformly heated by time averaging heat fields in a waveguide without substantial radiation. Like the subject matter of copending application Ser. No. 343,903, the present invention seeks to improve this by providing more control over the heating process to compensate for deposit heterogeneities, such as variations in dielectric properties with temperature or location, and spatial variations in density and heat requirements. Further, the invention has the ability to vary the heating of formations along the axis of propagation selectively so as to avoid heating barren zones, or to allow certain portions of the deposit to be produced earlier to equalize production rates. These improvements are achieved by inserting reactive elements along the electrodes in series and/or in shunt.

In the system and method of the present invention for the controlled in situ heat processing of hydrocarbonaceous earth formations, a plurality of electrodes are emplaced in respective spaced rows in a particular volume of hydrocarbonaceous material in a pattern which bounds the volume and defines a transmission line having the bounded volume as a dielectric medium bounded therein and which is configured such that the direction of propagation of aggregate modes of wave propagation therein is approximately parallel to the elongate axes of the electrodes. Electromagnetic energy is supplied to the transmission line at a frequency at which the spacing between respective rows of electrodes is less than about twice the skin depth at the frequency of the applied energy. The skin depth is the reciprocal of the attenuation constant $\alpha$ of the earth medium. The frequency is further selected to confine the electromagnetic energy substantially in the structure and to dissipate the electromagnetic energy substantially to the earth formations. In accordance with the present invention reactive elements are added along the line to control the characteristics of the line, namely its characteristic impedance and its propagation constant $\gamma$. Series elements are inserted at particular intervals by dividing the respective electrodes into discrete sections and inserting reactive elements between sections. It may also be possible to apply distributed elements. Shunt elements may be inserted between the electrodes and the surrounding strata. Such added reactive elements provide a controlled parameter line tailored to particular formations. This permits application of a controlled heating pattern. The present invention may be used to control the attenuation of the applied power to permit the uniform heating of highly absorbing deposits, such as moist tar sands. This also permits maintenance of a substantially constant characteristic impedance along the line so as to preclude unwanted reflections.

Thus, one aspect of the invention is to provide controlled heating patterns in hydrocarbonaceous earth formations by the controlled application of electromagnetic energy utilizing standing waves. However, in contrast to the system and method disclosed in the copending application Ser. No. 343,903, where controlled heating was achieved by changing the termination impedance and dwell times, the present invention does not require access to the distal end of the line or the use of multiple mode standing waves and related dwell times. Thus a principal aspect of this invention is to provide predetermined heating patterns by controlling the characteristics of a transmission line disposed in the earth by appropriate insertion of reactive elements in series and/or in shunt.

These and other aspects, objects and advantages of the present invention will become apparent from the following detailed description, particularly when taken in conjunction with the accompanying drawings.

BRIEF DESCRIPTION OF THE DRAWINGS

FIG. 4A is an enlarged diagrammatic illustration of a sectional view of a portion of a triplate transmission line disposed in accordance with the prior art without the insertion of reactive elements in accordance with the present invention, such view corresponding to the section taken in FIG. 2;

FIG. 4B is a diagrammatic illustration of the effective equivalent electrical circuit of the portion of the transmission line shown in FIG. 4A;

FIG. 5A is a diagrammatic illustration of the portion of the transmission line as shown in FIG. 4A upon the insertion of reactive elements in accordance with the present invention;

FIG. 5B is a diagrammatic illustration of the effective equivalent circuit of the portion of the transmission line shown in FIG. 5A;

FIG. 6A is an enlarged diagrammatic illustration, corresponding to FIG. 2, of a typical application of the present invention, with reactive impedances inserted in the excitor electrodes of the transmission line to effect substantially uniform heating of hydrocarbon rich formations and relatively little heating of lean formations and the overburden;

FIG. 6B is an illustration of the applied electric field developed by a transmission line as shown in FIG. 6A without the inserted reactive impedances;

FIG. 6C is an illustration of the applied electric field developed by the transmission line shown in FIG. 6A upon the insertion of reactive impedances in accordance with the present invention;

FIG. 7 is a vertical sectional view of a portion of a horizontal triplate line, corresponding to the section shown in FIG. 2, wherein impedances are added to the outer electrodes to effect a preselected heating pattern; and FIG. 8 is a vertical sectional view of a portion of a triplate line, corresponding to the section shown in FIG. 2, wherein coatings around the excitor electrodes effect a preselected heating pattern.

DETAILED DESCRIPTION OF PREFERRED EMBODIMENTS

Figure 1:
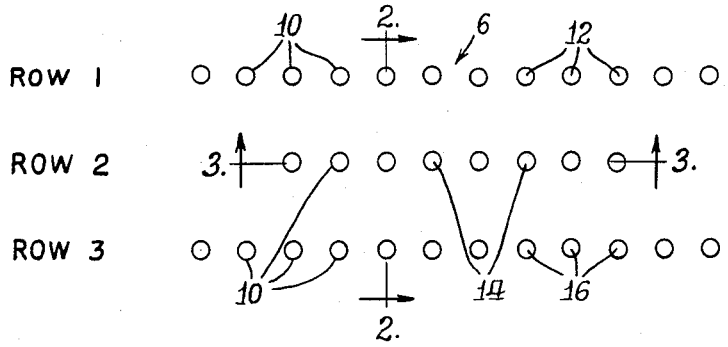
FIG. 1 is a diagrammatic illustration of a plan view of a triplate transmission line disposed in earth formations for application of the present invention.
Figure 2:
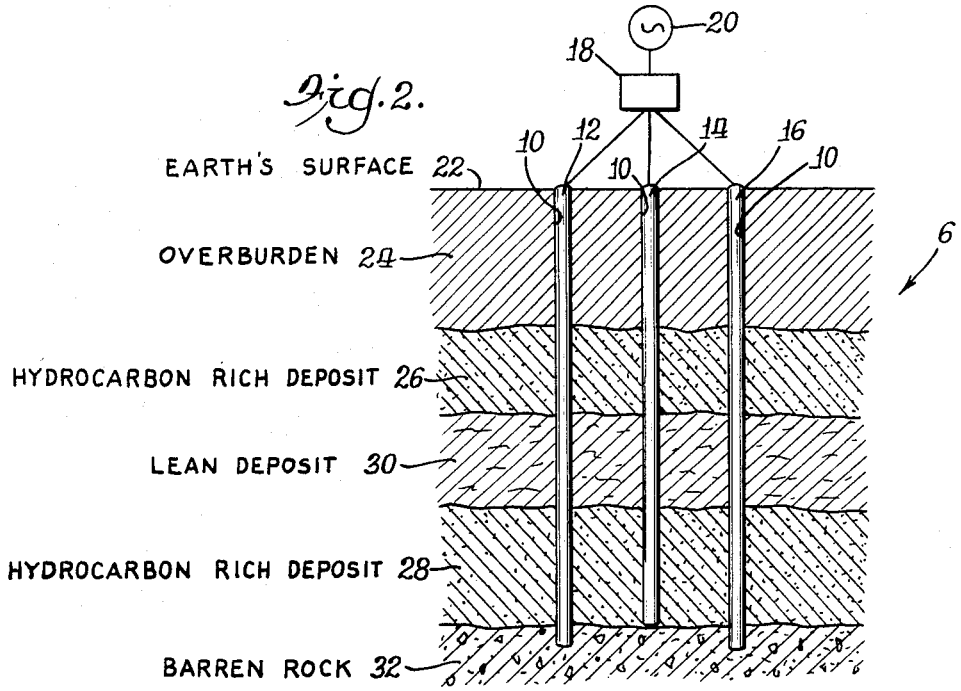
FIG. 2 is a diagrammatic illustration of a sectional view of the structure illustrated in FIG. 1, taken along line 2—2 in FIG. 1.
Figure 3:
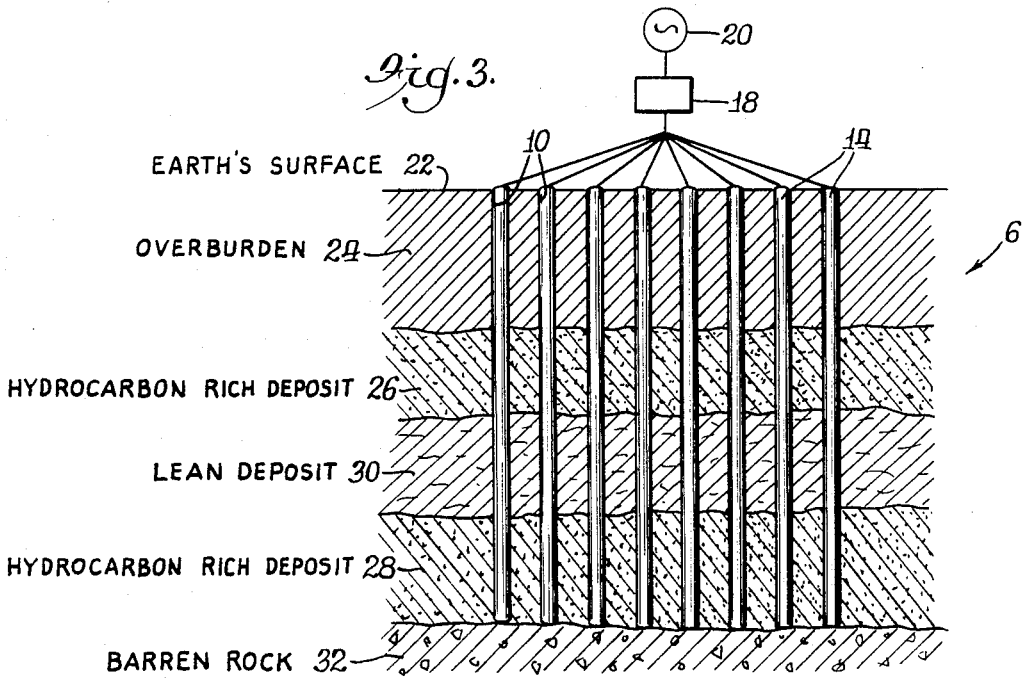
FIG. 3 is a diagrammatic illustration of a sectional view of the structure illustrated in FIG. 1, taken along line 3—3 in FIG. 1.

The present invention will be described primarily in respect to its application to a triplate transmission line as disclosed in Bridges and Taflove U.S. Pat. No. Re. 30,738. In FIGS. 1, 2 and 3 herein is illustrated a simplified construction of a triplate transmission line 6, particularly a line as shown in FIGS. 4A, 4B and 4C of the reissue patent utilizing rows of discrete electrodes to form the triplate line.

FIG. 1 shows a plan view of the triplate transmission line 6 emplaced in the earth in three parallel rows of boreholes 10 with elongated tubular electrodes 12, 14, 16 placed in the boreholes of respective rows. The individual elongated tubular electrodes 12, 14, 16 are placed in respective boreholes 10 that are drilled in relatively closely spaced relationship to form outer rows designated as row 1 and row 3, and a central row designated as row 2, with electrodes 12 in row 1, electrodes 14 in row 2 and electrodes 16 in row 3. The rows are spaced far apart relative to the spacing of adjacent electrodes of a row. FIG. 2 shows one electrode of each row. FIG. 3 illustrates the electrodes 14 of the central row, row 2. In the embodiment shown, the boreholes 10 are drilled into the earth and the electrodes 12, 14, 16 are emplaced therein. After insertion of the electrodes 12, 14, 16 into the respective boreholes 10, the electrodes 14 of row 2 are electrically connected together and coupled to one terminal of a matching network 18. The electrodes 12, 16 of the outer rows are also connected together and coupled to the other terminal of the matching network 18. Power is applied to the transmission line 6 formed by the electrodes 12, 14, 16, preferably at radio frequency. Power is applied to the structure from a power supply 20 through the matching network 18, which acts to match the power source 20 to the transmission line 6 for efficient coupling of power into the line. The electrodes 12, 16 are at substantially ground potential.

The boreholes 10 and the respective electrodes 12, 14, 16 extend from the earth's surface 22 through the overburden 24 and into hydrocarbon rich formations 26 and 28, which may be in layers interspersed with a lean formation 30 and with barren rock 32 below. In general the electrodes will extend through or nearly through the rich layers 26 and 28 of interest to or into the underlying barren rock 32.

The zone heated by applied energy is approximately that bounded by the electrodes 12, 16 and the end electrodes 14 of row 2. The electrodes 12, 14 16 of the transmission line 6 provide an effective confining waveguide structure for the alternating electric fields established by the electromagnetic excitation.

The use of an array of elongated cylindrical electrodes 12, 14, 16 to form a field confining transmission line 6 is advantageous in that installation of these units in boreholes 10 is more economical than, for example, installation of continuous plane sheets on the boundaries of the volume to be heated in situ. Also, enhanced electric fields in the vicinities of the borehole electrodes 12, 14, 16 through which recovery of the hydrocarbonous fluids ultimately occurs, is actually a benefit (even though it represents a degree of heating non-uniformity in a system where even heating is striven for) as the formations near the borehole electrodes will be heated first. This helps create initial permeability and porosity, which facilitates orderly recovery of fluids as the overall bounded volume later rises in temperature. To achieve field confinement, the spacing between adjacent electrodes of a respective row should be less than about a quarter wavelength and, preferably, less than about an eighth of a wavelength.

Very large volumes of hydrocarbonaceous deposits can be heat processed using the described technique, for example, volumes of the order of $10^5$ to $10^6$ $m^3$ of oil shale. Large blocks can, if desired, be processed in sequence by extending the lengths of the rows of boreholes 10 and electrodes 12, 14, 16. Further field confinement can be provided by adding conductors in boreholes at the ends of the rows to form a shielding structure.

Comparison of FIGS. 4A and 4B with FIGS. 5A and 5B illustrates the general case of the present invention. In FIG. 4A is illustrated diagrammatically a part of a triplate transmission line 6 formed of excitor electrodes 14 and guard electrodes 12 and 16 inserted in the earth formations and in intimate contact therewith so that the earth formations form a dielectric medium 34 in which the transmission line 6 is disposed. The line is actually distributed impedances, but the effective equivalent circuit for such transmission line is often approximated, as shown in FIG. 4B, by a plurality of discrete lumped impedances $Z_1$ in series, with their junctions shunted to the grounded guard electrodes by discrete lumped admittances $Y_1$, shown as shunt impedances. The propagation constant $\gamma$ of the line is then:

$$\gamma=\alpha+j\beta=(Z_1Y_1)^{\frac{1}{2}} \quad (1)$$

where $\alpha$ is the attenuation constant and $\beta$ is the phase constant, and the characteristic impedance $Z_o$ is:

$$Z_o=(Z_1/Y_1)^{\frac{1}{2}} \quad (2)$$

As shown diagrammatically in FIG. 5A, in accordance with the present invention discrete reactive impedances 36, each having impedance $Z_s$, are inserted in series between sections 37 of the excitor electrodes at spaced locations along the line, and discrete reactive impedances 38, each having impedance $Z_y$, are added at locations along the line between the center electrodes 14 and the dielectric 34. Such arrangement has an effective equivalent circuit as shown in FIG. 5B wherein each impedance $Z_1$ has an impedance $Z_s$ in series therewith and each shunt impedance $1/Y_1$ has an impedance $Z_y$ in series therewith. The propagation constant $\gamma$ of such line is then:

$$\gamma=\alpha+j\beta=(Z_1+Z_s)^{\frac{1}{2}}(Z_y+1/Y_1)^{-\frac{1}{2}} \quad (3)$$

and its characteristic impedance $Z_o$ is $$Z_o=(Z_1+Z_s)^{\frac{1}{2}}(Z_y+1/Y_1)^{\frac{1}{2}} \quad (4)$$

The purpose of disposing reactances along the transmission line is to provide predetermined transmission line characteristics so as to provide a preselected heating pattern, such as one that preferentially heats hydrocarbon rich formations. Ideally this would involve the use of very many reactive elements inserted in the line as to approximate closely the distributed reactance of a desired transmission line. However, for practical purposes, a relatively few discrete elements may be emplaced to achieve a suitable result, e.g., preferential heating of certain formations. In general the spacing between such discrete reactances should be significantly shorter than a quarter wave length ($\lambda/4$) of the standing wave. In this case, the performance will be about the same as with distributed impedance, except that discontinuities in the electric field in the deposit will be observable near where the reactors are inserted. A distributed impedance may be approximated as closely as desired by inserting suitable impedances at suitably close spacing.

In some cases it may be possible and desirable to insert a single large reactance rather than a series of distributed reactances. An objective of such a large insertion would be to transform the state of the standing waves from, say, a high impedance (large line voltage, low line current) state to a low impedance (low line voltage, high current) state. This can be done provided the larger value of discontinuity is acceptable or appropriate impedance adjustments are made elsewhere in the line.

FIGS. 6A, 6B and 6C illustrate the effect of the insertion of particular discrete reactive impedances 36 in the excitor electrodes 14 at certain spaced locations along the line to effect substantially uniform heating of the rich deposits 26, 28 while effecting relatively little heating of the lean deposit 30, the overburden 24, or the barren rock 32. In the specific embodiment illustrated, discrete capacitors 40 are the reactances 36 inserted in series between sections 37 of the excitor electrodes 14 at spaced locations in respective earth formations. Discrete inductors 44 are the reactances 36 inserted between sections 37 of the excitor electrodes 14 at the interfaces between the different earth formations.

The effect of such series impedances is evident from consideration of the characteristic Equations (3) and (4) above and is illustrated by comparison of the curves of FIGS. 6B and 6C. FIG. 6B shows the standing wave 42 produced in the formations in the absence of the inserted series impedances 36, and FIG. 6C shows the standing wave 45 produced upon their insertion. For the purposes of illustration, the standing wave 45 of FIG. 6C is for the case where there are very many capacitances 40 (more than illustrated in FIG. 6A) inserted at relatively closely spaced intervals to approximate distributed impedances. With fewer capacitances, the curve would be bumpier. However, the ideal relationship can be approached as closely as desired by inserting more capacitances at closer spacing. Similarly, the curve of FIG. 6C assumes more distributed inductances at the interfaces between formations.

For a simple explanation of the phenomenon whereby the electric field remains relatively high and constant over the rich deposits 26 and 30 and relatively low and constant over the lean deposit 28 and the overburden 24, reference may be made to Equation (3). Assuming the extreme case of a perfectly conducting line in a lossless dielectric medium, which is not far from reality in many cases, Equation (3) reduces to $$\gamma=j\beta=\omega(LC)^{\frac{1}{2}} \quad (5)$$

where $\omega$ is the frequency in radians per second, L is the series inductance of the line, and C the shunt capacitance. The insertion of capacitance 40 has the effect of offsetting the series inductance L, making the phase constant $\beta$ smaller and consequently making the wavelength $\gamma$ of the standing wave greater, the relationship being:

$$\beta=2\pi/\lambda \quad (6)$$

Maintaining a relatively small phase constant by insertion of capacitors of appropriate capacitance hence maintains a relatively long standing wave which thus provides a relatively constant applied voltage over the respective formations. This permits a constant exciting voltage to be applied to the hydrocarbon rich formations 26 and 28 as shown at sections 45*a* and 45*b* of the standing wave 45.

In order to provide less heat to the lean formation 30 and the overburden 24, the series inductors 44 are inserted at the interfaces between formations. The effect of series inductance is to increase the phase constant $\beta$ according to Equation (5) and hence to decrease the wavelength of the standing wave. By inserting inductors of appropriate inductance, the standing wave may be caused to advance a quarter wavelength in a short space (section 45*c*) in going from the rich deposit 28 to the lean deposit 30 so as to drop the applied exciting voltage at the lean deposit 30 to near zero, providing little heat to the lean deposit.

Series capacitors 40 in the lean deposit 30 hold the section 45*d* of the standing wave near zero. At the interface between the lean deposit 30 and the rich deposit 26, inductors 44 again provide a rapid advance in the phase of the standing wave 45 (section 45*e*) to apply a relatively high exciting voltage to the rich deposit 26. Series capacitors 40 in the rich deposit 26 hold the standing wave (section 45*b*) near maximum. At the interface between the rich deposit 26 and the overburden 24, inductors 44 again provide a rapid advance in the phase of the standing wave (section 45*f*) so as to drop the applied voltage near zero, where it is kept by series capacitors 40 in the overburden 24 (section 45*g*).

Another way of looking at the effect of the series capacitors 40 and inductors 44 is that they effectively stretch and compress the standing wave shown in FIG. 6B. The peaks (sections 45*a* and 45*b*) and zero crossings (sections 45*d* and 45*g*) are stretched and the transitions (sections 45*c*, 45*e* and 45*f*) are compressed.

As noted above, the simple arrangement just described may produce undesirable discontinuities in the line. That is, the discrete inductors 44 provide substantial changes in the characteristic impedance of the line. These discontinuities could produce substantial reflections at the discontinuities. Such reflections of the applied energy could distort the standing waves and keep much of the energy from reaching the end of the line. To avoid such reflections, depending upon the electrical parameters of the deposit shunt inductors 46 may be inserted at the series inductors 44, between the electrodes 14 and the surrounding dielectric 34. In accordance with Equation (4), the insertion of such shunt inductors 46 changes the characteristic impedance $Z_o$ at the series inductors 44. Appropriate shunt inductance can make the characteristic impedance there match closely enough the characteristic impedance in the regions of the series capacitors 40 so as to make reflections relatively inconsequential.

In FIG. 7 is illustrated a form of the invention useful where the triplate line is asymmetrically positioned in earth formations. More particularly, in FIG. 7 is shown a horizontally disposed triplate line where the upper ground electrodes 16 and the excitor electrodes 14 encompass a relatively loss-free, low dielectric constant layer 52, while the excitor electrodes 14 and the lower ground electrodes 12 encompass a somewhat more lossy, higher dielectric constant layer 54. As a consequence the possiblity exists for interfering modes; that is, a wave in the upper layer 52 may experience different absorption and phase delay than a wave in the lower layer 54. This can lead to undesired deviations from the desired heating pattern.

To mitigate the problem, a shunt impedance 38 in the form of a dielectric sheath 48 may be placed around each of the ground electrodes 12, 16, with the sheath emcompassing the lower ground electrodes 12 being of greater thickness. Assuming that the dielectric is nearly loss-free, the increased thickness will in effect reduce both the propagation loss and the phase delay and allow equalization of behavior. A related problem can be experienced in very lossy deposits, wherein the propagation loss along a line in nearly intimate contact with the earth media may be too high for the preassigned operating frequency. While lowering the operating frequency could reduce the propagation loss to an acceptable value, this option is not always available. Furthermore, it may be desirable to operate at a higher frequency such that standing waves are created to heat certain segments or layers of the deposit selectively.

To decrease the propagation loss along the line, the electrodes can be sheathed by a relatively loss-free dielectric. Although a lossy dielectric could be employed, the excess heating of this material often produces no direct benefit, unless preferential heating near the electrodes is desired. The sheathes 48 may be as shown in FIG. 7; however, in general, it is appropriate to sheathe only the excitor electrodes 14. Insertion of a dielectric sheath reduces the propagation losses ($\alpha$) along the line and also decreases the phase delay ($\beta$). In this case, the objective of sheathing the electrodes is to reduce the propagation losses rather than to mitigate the effects of excessive field near the electrodes as may be achieved in the manner disclosed in the co-pending application Ser. No. 363,765, filed Mar. 31, 1982 by Bridges and Taflove for Mitigation of Radio Frequency Electric Field Peaking in Controlled Heat Processing of Hydrocarbonaceous Formations In Situ, now U.S. Pat. No. 4,476,926, issued Oct. 16, 1984. When breakdown migitation is not required, the dielectric parameters and sheath thickness can be considerably different than the parameters and dimensions required to prevent breakdown. The thickness can then be very thin and the dielectric strength of normal value. On the other hand, propagation control and dielectric breakdown suppression can be simultaneously engineered when both breakdown suppression and propagation control are desired.

In more or less homogenous deposits which are excessively lossy, some reduction of the propagation losses are desired. However, optimum ranges may exist for this reduction, depending on whether the line is excited from one end or both ends. If the losses along the line are insufficient, then excessive voltages and fields will be required to develop the required heating levels. On the other hand, if the losses along the line are excessive, then only the portion of the deposit next to the excited electrodes 14 will be heated. For a line of length L and fed at one end, $\alpha L$ should preferably range between 0.005 and 1 nepers. In the case of lines fed from both ends, the preferred range can be increased from 0.01 to 2 nepers. The foregoing has assumed a uniform thickness of the dielectric sheath along the length of the deposit. On the other hand, nonuniform spatial distribution of thickness can be utilized:

(1) in a homogenous deposit to equalize the electric field strength along the line in the deposit; and (2) in a heterogenous deposit to develop a prescribed heating pattern, generally to compensate for a different heat requirement in the deposit itself and to avoid heating barren layers.

In case (1) the thickness of the dielectric sheath is increased (or its relative dielectric constant reduced) relative to the thickness at the distal end. This causes less absorption due to reduced attenuation $\alpha$ near the feed relative to the distal end. As a consequence, some mitigation of excessive fields near the feed end is possible while maintaining a high average absorption and roughly equal field intensities along the line.

In case (2) it is desired to control the heating such that different heating rates are developed in different layers of the deposit. By varying the ratio $t/\epsilon$ of the thickness t of the dielectric sheath to its dielectric constant $\epsilon$, it is possible to control the absorption as the wave progresses down the line. To decrease the absorption (lower the heating), $t/\epsilon$ should be made large. To increase the heating, $t/\epsilon$ should be made small. A small capacitance capacitor inserted between the electrode and the deposit will decrease $\alpha$ and $\beta$. The smaller the capacitance, the greater the decreases in $\alpha$ and $\beta$. In other words, a small capacitance increases the voltage drop in the lossless dielectric of the sheath and thereby reduces the electric field in the deposit.

In FIG. 8 is illustrated the case where the thickness of the sheath 48 is varied along the line to vary the heating pattern in this manner. To assure coupling to the formations while making the electrodes 14 of constant diameter in boreholes 10 of constant diameter, conductive elements 50, which may simply be saltwater, may be disposed between the thinner sheathes 48 and the surrounding walls of the respective boreholes 10.

In the case of the example of FIG. 8, reflections or discontinuances will occur at change points in the $t/\epsilon$ ratio. Two ways to mitigate the effect of such reflections are:

(1) Insert additional impedances to maintain a nearly constant characteristic impedance $Z_o$.

(2) Choose a very low frequency of excitation in combination with the propagation phase constant $\beta$, such that $\beta$ times line length is less than two radians. This causes the line to act more as a unit, or simple lumped element, and not as a distributed line.

The impedances 36 and 38 that are added to the transmission line 6 are reactive impedances, that is, inductors or capacitors, as any substantial resistance would dissipate energy wastefully. That is not to say that some resistance is not tolerable, and some resistance is unavoidable. The term reactance or reactive impedance thus encompasses impedances that are primarily capacitive or inductive without substantial resistance.

The capacitors and inductors used for the impedances 36 and 38 may be conventional, although they may take particular configurations to meet space requirements. As the frequencies contemplated are relatively high, the inductors and capacitors may be relatively small while providing the desired impedances. For example, the series capacitors may be simple parallel plate capacitors, open circuit lines or series LC circuits at a particular operating frequency. The series inductance may be simple coils or short circuited lines. Shunt inductors may be simple spring clips of some length which contact the deposit and the respective electrodes, or they may be series LC inserts at a particular operating frequency. Shunt capacitance may be provided by dielectric coatings on the respective electrodes.

There are thus a number of aspects of the present invention that provide improved controlled electromagnetic heating of hydrocarbonaceous deposits in situ. Provision is made for more uniform heating of certain deposits in a simple manner as well as for other controlled heating patterns. It is to be kept in mind that uniform application of electric field does not assure the uniform application of power. The earth formations have variations in dielectric properties, both with temperature and spatially. They also vary as the constituency of the formations changes upon operation of the method. There are also variations in thermal capacity, density and specific heat. The dielectric properties change markedly as water is driven off. Unless the formations are relatively uniform in character, the uniform application of electric power does not effect uniform temperature rise. It is common for uniform application of electric power to produce substantially uniform temperature rise; however, nonuniform controlled application of electromagnetic energy in accordance with the present invention may be used to produce relatively uniform temperature rises in formations having substantial heterogeneities. Of course, nonuniform controlled application of electromagnetic energy may be used to produce a desired temperature distribution. It is particularly applicable to conditions where there are barren zones interspersed in the hydrocarbonaceous deposits, for wasteful heating of such zones can be reduced while concentrating heating in the adjacent deposits. Controlled nonuniform heating has been shown to be helpful in allowing certain portions of a deposit to be produced first, as to equalize production rates. It may be desirable to produce lower portions of a deposit first in order to improve permeability for producing the upper portions by gravity through the lower portions.

Controlled heating patterns are achieved in accordance with certain aspects of this invention by changing the characteristic impedance $Z_o$ and propagation constant $\gamma$ of the transmission line to create distributed fields in the deposit having a desired predetermined heating pattern at a selected frequency. The duration (dwell time) at a given frequency and/or the level of electromagnetic excitation may be varied to control heating patterns.

Although certain preferred embodiments of the invention have been described with particularity, many modifications may be made therein within the scope of the invention. Other controlled heating patterns may be created using the present invention. Other electrode structures may be used, and they may be disposed differently. For example, in some situations a biplate line can be used.

The invention is applicable to a system in which a transmission line is formed by electrodes disposed in earth formations, where the earth formations act as a dielectric. Electromagnetic energy at a selected frequency or at selected frequencies, preferably at radio frequencies, is supplied to the waveguide for controlled dissipation in the formations.

Unless otherwise required by the context, the term "dielectric" is used herein in the general sense of a medium capable of supporting an electric stress and recovering at least a portion of the energy required to establish an electric field therein. The term thus includes the dielectric earth media considered here as imperfect dielectrics which can be characterized by both real and imaginary components, $\epsilon'$, $\epsilon''$. A wide range of such media are included wherein $\epsilon''$ can be either larger or smaller than $\epsilon'$.

"Radio frequency" is similarly used broadly herein, unless the context requires otherwise, to mean any frequency used for radio communications. Typically this ranges upward from 10 KHz; however, frequencies as low as 45 Hz have been considered for a world-wide communications system for submarines. The frequencies currently contemplated for a large commercial oil shale facility range from 30 KHz to 3 MHz and for tar sand deposits as low as 25 Hz.

While the above discussion considered insertion of series or shunt elements or discrete entities it is also possible to develop these elements in distributed form. The simplest example of this is coating the electrode with a dielectric sheath. It should be noted that by insertion of such series or shunt elements, the characteristic impedance and propagation constant become more strongly dependent on the precise frequency employed. In some cases it is possible to design some section of the line where the transmission line properties are more dependent on the operational frequency than others. This allows changing the properties of the line in one portion of the deposit without materially altering the properties in another by simply varying the frequency.

What is claimed is:

1. A system for preferential in situ heating of earth formations comprising:

a plurality of elongated conductive electrodes emplaced in boreholes in earth formations in respective spaced rows bounding a particular volume of said earth formations and forming a transmission line extending in the direction of said electrodes with said particular volume of said earth formations providing a dielectric medium between respective said rows of electrodes, each electrode being in a different respective borehole, means for supplying electromagnetic energy to said transmission line at a frequency at which the spacing between respective said rows is less than about twice the skin depth at the frequency of said applied energy, and reactance means disposed along respective said electrodes to provide predetermined effective transmission line characteristics for developing a predetermined heating pattern in said earth formations.

2. A system for preferential in situ heating of earth formations comprising:

a plurality of elongated conductive electrodes emplaced in earth formations in respective spaced rows bounding a particular volume of said earth formations and forming a transmission line extending in the direction of said electrodes with said particular volume of said earth formations providing a dielectric medium between respective said rows of electrodes, means for supplying electromagnetic energy to said transmission line at a frequency at which the spacing between respective said rows is less than about twice the skin depth at the frequency of said applied energy, and reactance means disposed along respective said electrodes to provide predetermined effective transmission line characteristics for developing a predetermined heating pattern in said earth formations, said reactance means providing reactances between said earth formations and respective sections of said electrodes that are stratigraphically varied to develop said predetermined heating pattern.

3. A system for preferential in situ heating of earth formations comprising:

a plurality of elongated conductive electrodes emplaced in earth formations in respective spaced rows bounding a particular volume of said earth formations and forming a transmission line extending in the direction of said electrodes with said particular volume of said earth formations providing a dielectric medium between respective said rows of electrodes, means for supplying electromagnetic energy to said transmission line at a frequency at which the spacing between respective said rows is less than about twice the skin depth at the frequency of said applied energy, and reactance means disposed along respective said electrodes to provide predetermined effective transmission line characteristics for developing a predetermined heating pattern in said earth formations, said reactance means comprising dielectric coating about respective said electrodes, the ratio of the thickness of said dielectric coating to relative dielectric constant being varied along the respective said electrodes.

4. A system for preferential in situ heating of earth formations comprising:

a plurality of elongated conductive electrodes emplaced in earth formations in respective spaced rows bounding a particular volume of said earth formations and forming a transmission line extending in the direction of said electrodes with said particular volume of said earth formations providing a dielectric medium between respective said rows of electrodes, means for supplying electromagnetic energy to said transmission line at a frequency at which the spacing between respective said rows is less than about twice the skin depth at the frequency of said applied energy, and reactance means disposed along respective said electrodes to provide predetermined effective transmission line characteristics for developing a predetermined heating pattern in said earth formations, said reactance means comprising dielectric coating about respective said electrodes, said dielectric coating being applied at conductive earth formations.

5. A system for preferential in situ heating of earth formations comprising:

a plurality of elongated conductive electrodes emplaced in earth formations in respective spaced rows bounding a particular volume of said earth formations and forming a transmission line extending in the direction of said electrodes with said particular volume of said earth formations providing a dielectric medium between respective said rows of electrodes, means for supplying electromagnetic energy to said transmission line at a frequency at which the spacing between respective said rows is less than about twice the skin depth at the frequency of said applied energy, and reactance means disposed along respective said electrodes to provide different effective transmission line characteristics in different respective zones of said earth formations and heat at least one particular respective said zone preferentially upon application of electromagnetic energy to said transmission line.

6. A system in accordance with claim 5 wherein said reactance means are disposed discretely between respective sections of respective said electrodes.

7. A system in accordance with claim 6 further including further reactance means disposed between respective said sections of respective said electrodes and portions of said earth formations adjacent thereto.

8. A system in accordance with claim 6 wherein capacitance means are disposed between respective said sections in given earth formations, and inductance means are disposed between respective said sections adjacent an interface between substantially different earth formations.

9. A system in accordance with claim 6 further including inductance means disposed between respective said sections of respective said electrodes and portions of said earth formations adjacent said interface.

10. A system in accordance with any one of claims 1 to 9 wherein said conductive electrodes are disposed in three parallel rows with the electrodes of the outer rows at substantially ground potential.

11. A system in accordance with claim 10 wherein respective said reactance means are disposed along said electrodes of the center row of said three parallel rows.

12. A method for preferentially heating earth formations in situ comprising:

emplacing a plurality of elongated conductive electrodes in earth formations in respective spaced rows bounding a particular volume of said earth formations and forming a transmission line extending in the direction of said electrodes with said particular volume of said earth formations providing a dielectric medium between respective said rows of electrodes, supplying electromagnetic energy to said transmission line at a frequency at which the spacing between respective said rows is less than about twice the skin depth at the frequency of said applied energy, and providing predetermined effective transmission line characteristics by adding reactance to said line along respective said electrodes to develop a predetermined heating pattern in said earth formations.

13. A method in accordance with claim 12 wherein said electrodes are coated with a dielectric coating.

14. A method for preferentially heating earth formations in situ comprising:

emplacing a plurality of elongated conductive electrodes in earth formations in respective spaced rows bounding a particular volume of said earth formations and forming a transmission line extending in the direction of said electrodes with said particular volume of said earth formations providing a dielectric medium between respective said rows of electrodes, supplying electromagnetic energy to said transmission line at a frequency at which the spacing between respective said rows is less than about twice the skin depth at the frequency of said applied energy, and providing predetermined effective transmission line characteristics by adding reactance to said line along respective said electrodes to develop a predetermined heating pattern in said earth formations, wherein said electrodes are coated with a dielectric coating, and the ratio of the thickness of said dielectric coating to its relative dielectric constant is varied along the respective electrodes.

15. A method for preferentially heating earth formations in situ comprising:

emplacing a plurality of elongated conductive electrodes in earth formations in respective spaced rows bounding a particular volume of said earth formations and forming a transmission line extending in the direction of said electrodes with said particular volume of said earth formations providing a dielectric medium between respective said rows of electrodes, supplying electromagnetic energy to said transmission line at a frequency at which the spacing between respective said rows is less than about twice the skin depth at the frequency of said applied energy, and providing predetermined effective transmission line characteristics by adding reactance to said line along respective said electrodes to develop a predetermined heating pattern in said earth formations, wherein said electrodes are coated with a dielectric coating, and said dielectric coating is applied at conductive earth formations.

16. A method for preferentially heating earth formations in situ comprising:

emplacing a plurality of elongated conductive electrodes in earth formations in respective spaced rows bounding a particular volume of said earth formations and forming a transmission line extending in the direction of said electrodes with said particular volume of said earth formations providing a dielectric medium between respective said rows of electrodes, supplying electromagnetic energy to said transmission line at a frequency at which the spacing between respective said rows is less than about twice the skin depth at the frequency of said applied energy, and providing different effective transmission line characteristics in different respective zones of said earth formations by adding reactance to said line along respective said electrodes to heat at least one particular respective said zone preferentially upon application of electromagnetic energy to said transmission line.

17. A method in accordance with claim 16 wherein said reactance is added discretely between respective sections of respective said electrodes.

18. A method in accordance with claim 17 wherein further reactance is added between respective said sections of respective said electrodes and portions of said earth formations adjacent thereto.

19. A method in accordance with claim 17 wherein capacitance is added between respective said sections in given earth formations, and inductance is added between respective said sections adjacent an interface between substantially different earth formations.

20. A method in accordance with claim 19 wherein inductance is added between respective said sections of respective said electrodes and adjacent portions of said earth formations adjacent said interface.

21. A method in accordance with any one of claims 12 to 20 wherein said conductive electrodes are disposed in three parallel rows, and the electrodes of the outer rows are substantially grounded.

22. A method in accordance with claim 21 wherein said reactance is added along said electrodes of the center row of said three parallel rows.

* * * * *

UNITED STATES PATENT AND TRADEMARK OFFICE

CERTIFICATE OF CORRECTION

PATENT NO. : 4,498,535

DATED : February 12, 1985

INVENTOR(S) : Jack E. Bridges

It is certified that error appears in the above-identified patent and that said Letters Patent is hereby corrected as shown below:

Column 1, line 21, after "pattern" insert a period.

Column 1, line 25, after "liquids" insert a period.

Column 2, line 13, after "thereof" insert a period.

Column 2, line 66, after "Controlled" delete the comma.

Column 2, line 67, after "Formations" insert a comma.

Column 8, line 30, change "$\gamma$" to --$\lambda$--.

Signed and Sealed this

*Twentieth* Day of *August 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,498,535

DATED : February 12, 1985

INVENTOR(S) : Jack E. Bridges

It is certified that error appears in the above-identified patent and that said Letters Patent is hereby corrected as shown below:

Column 1, after the first paragraph insert the following paragraph: --The Government of the United States of America has rights in this invention pursuant to Contract No. DE-AC01-79ER10181 awarded by the U.S. Department of Energy.--

Signed and Sealed this

Twenty-eighth Day of November 1989

*Attest:*

JEFFREY M. SAMUELS

*Attesting Officer* *Acting Commissioner of Patents and Trademarks*